United States Patent [19]

Kondo et al.

[11] Patent Number: 4,790,876

[45] Date of Patent: Dec. 13, 1988

[54] CHEMICAL COPPER-BLATING BATH

[75] Inventors: Koji Kondo, Chiryu; Katuhiko Murakawa, Obu; Nobumasa Ishida, Chiryu; Junji Ishikawa, Nagoya; Kaoru Nomoto, Okazaki; Futoshi Ishikawa, Nagoya, all of Japan

[73] Assignee: Nippondenso Co., Ltd., Kariya, Japan

[21] Appl. No.: 68,366

[22] Filed: Jul. 1, 1987

[30] Foreign Application Priority Data

Jul. 1, 1986 [JP] Japan ..... 61-152620
Jun. 23, 1987 [JP] Japan ..... 62-154309

[51] Int. Cl.[4] ..... B22F 7/00; B05D 5/12

[52] U.S. Cl. ..... 106/1.23; 106/1.26; 427/96; 427/98

[58] Field of Search ..... 106/1.23, 1.26; 427/98, 427/96

[56] References Cited

U.S. PATENT DOCUMENTS

| | | | |
|---|---|---|---|
| 3,246,994 | 4/1966 | Ritchie | 106/1.26 |
| 3,516,848 | 6/1970 | Foulke | 427/98 |
| 4,152,477 | 5/1979 | Haruta et al. | 428/206 |
| 4,655,833 | 4/1987 | Amelio | 106/1.23 |

OTHER PUBLICATIONS

Abstract 60-149784 "Electroless Copper Plating Solution", Aug. 7, 1985.

Abstract 60-155683 "Electroless Copper Plating Solution", Aug. 15, 1985.

*Primary Examiner*—Theodore Morris

*Attorney, Agent, or Firm*—Cushman, Darby & Cushman

[57] ABSTRACT

In a chemical copper-plating bath comprising a copper sulfate, a complexing agent, a reducing agent, and a pH-adjusting agent, borofluoride is added to enhance the deposition speed of Cu, thus eliminating the problems of a complicated control of the bath.

17 Claims, 1 Drawing Sheet

CHEMICAL COPPER-BLATING BATH

BACKGROUND OF THE INVENTION

1. Field of the Invention

The present invention is related to a chemical copper-plating bath.

2. Description of the Related Arts

Chemical copper-plating baths, also referred to as electroless copper-plating baths, consist of a copper salt, a complexing agent, a reducing agent, and a pH-adjusting agent. Such a chemical copper-plating bath has a disadvantage of a slow plating deposition speed ranging from 1 to 2 μm/hr, which is partly attributable to a great reduction in the depositing speed caused by the presence of additives (such as potassium ferrocyanide, 2,2'-bipyridyl, and the like) for improving the physical properties of a copper plating film. Namely, the plating deposition speed in the bath consisting of a copper salt, a complexing agent, a reducing agent, and a pH-adjusting agent is as high as 10 μm/hr, but if additives are present in the bath, the plating deposition speed is reduced to 1~2 μm/hr. Accordingly, if a high speed, thick plating deposition is required, copper-plating films are usually formed by an electrolytic deposition of copper. For example, a method for forming conductors on a printed circuit by chemical copper plating (referred to as the additive method) is used, and has advantages such as the attachment of electrodes to the workpiece becomes unnecessary for the formation of a conductor circuit, and thus costs are reduced and the process is simplified. The additive method also makes it possible to enhance the integration of conductor circuits, and thus the realization of fine conductor lines. Nevertheless, this additive method can be practiced only by providing a chemical copper plating bath by which a high speed and thick deposition of copper plating can be achieved, and much research has been carried out into the discovery of such a chemical copper plating bath. According to research into chemical copper plating bath compositions which have been carried out in an attempt to meet the requests for a high speed and thick plating deposition, it has been proposed to add a trace amount of a stabilizing agent and an activating element to the bath with the above described general composition. The plating deposition speed attained by such a proposal is generally as high as 10 μm/hr.

According to Japanese Unexamined Patent Publication No. 59-25965, a plating deposition speed of approximately 72 μm/hr (at 70° C.) is attained by using as the accelerating agent 2-mercaptobenzothiazole, imidazole, 4-hydroxypyridine, pirindine, or a compound of thereof. However, this accelerating agent must be used in only a small amount, and thus control of the bath is difficult.

SUMMARY OF THE INVENTION

The high speed plating baths proposed heretofore have too many problems to be implemented industrially, such as the small and critical addition amount.

Accordingly, an object of the present invention is to overcome the problems of the high speed plating baths and to provide an additive which remarkably enhances the plating deposition speed when added to any known chemical copper platig bath.

In accordance with the objects of present invention, there is provided a chemical copper plating bath comprising a copper salt, a complexing agent, a reducing agent, and a pH-adjusting agent, and further, an additive consisting of borofluoride.

DESCRIPTION OF THE PREFERRED EMBODIMENTS

Figure 1:
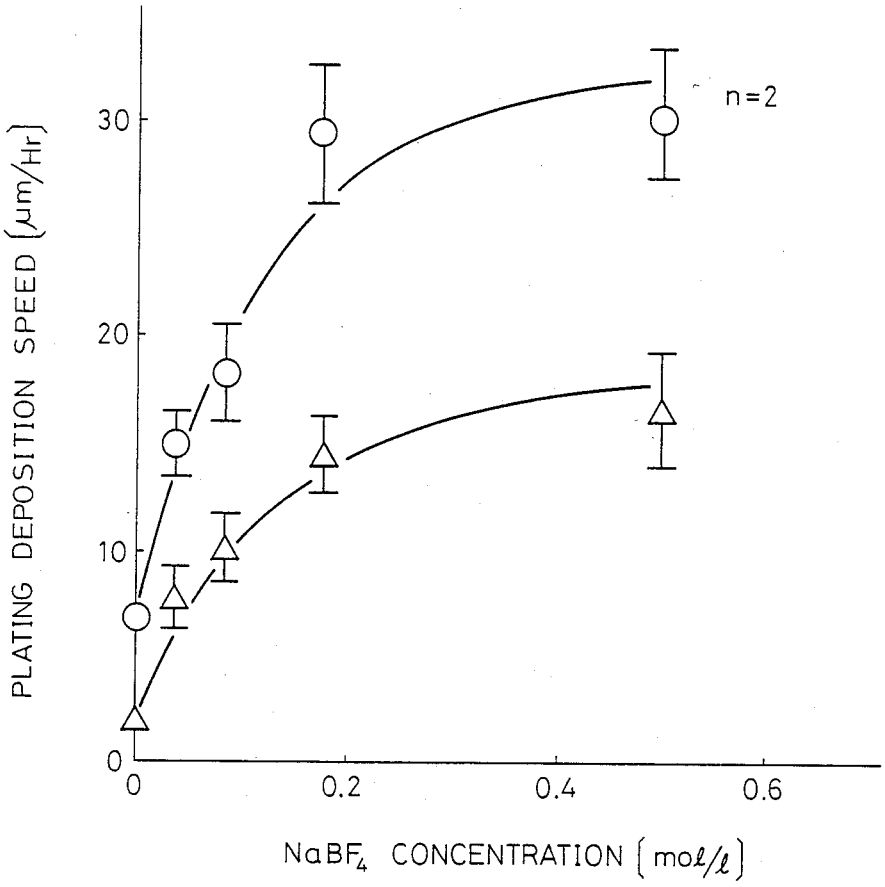
FIG. 1 is a graph which illustrates the relationships between deposition speed of Cu plating and the $NaBF_4$ concentration in two kinds of the $CuSO_4$-NNN'N'-tetrakis(2-hydroxypropyl)ethylenediamine series plating liquid (o-symbol) and the $CuSO_4$-EDTA series plating liquid (Δ-symbol).

The enhancement of the plating speed is described specifically with reference to an experiment by the present inventors.

| Inventive Experiment<br>Ingredients of Chemical Copper Plating Bath | |
|---|---|
| Copper salt | $CuSO_4$ (0.06 mol/l) |
| Complexing agent | NNN'N—tetrakis(2-hydroxypropyl) ethylenediamine |
| Reducing agent | HCHO (0.25 mol/l) |
| $NaBF_4$ | 0.1 mol/l |
| pH | 12.5 |
| Bath temperature | 45° C. |
| Plating deposition speed | 30 μm/hr |

| Comparative Experiment<br>Ingredients of Chemical Copper Plating Bath | |
|---|---|
| Copper salt | $CuSO_4$ (0.06 mol/l) |
| Complexing agent | NNN'N—tetrakis(2-hydroxypropyl) ethylenediamine |
| Reducing agent | HCHO (0.25 mol/l) |
| pH | 12.5 (25° C.) |
| Bath temperature | 45° C. |
| Plating deposition speed | 8 μm/hr |

As shown in these experiments, an extremely high plating deposition speed is realized by the addition of $NaBF_4$.

The chemical copper-plating bath according to the present invention is now described in more detail.

The copper salt is the source for supplying a metallic copper, and therefore, copper sulfate, copper chloride, copper sulfamate, and the like can be used as the copper salt but are not specifically limitative thereto in the present invention.

Any known complexing agent can be used provided that such an agent can form a copper complex. Preferred complexing agents are NNN'N'-tetrakis(2-hydroxypropyl)ethylenediamine and EDTA.

Any reducing agent can be used provided that copper ions are reduced to copper atoms thereby. For example, formalin, sodium hypophosphite, hydrazine, and the like can be used.

Any nonlimiting agent can be used for adjusting the pH, provided that such an agent can adjust the pH to 11.5 or more (at 25° C.).

Any salt containing $BF_4^-$ can be used as the borofluoride. Namely, borofluorides such as $KBF_4$, $LiBF_4$, $RbBF_4$ and $CsBF_4$ can be used instead of $NaBF_4$.

The concentrations of the above described copper salt, complexing agent, reducing agent, pH adjusting agent, and borofluoride are not specifically limited, and may be in an appropriate concentration such that the copper salt is converted to a copper complex and is reduced at an appropriate pH. The invention is further described with reference to the drawing.

Referring to FIG. 1, if $NaBF_4$ is added in an amount of approximately 0.02 mol/l into a chemical copper plating bath (pH 12.5, 40° C.), the plating deposition speed of the $CuSO_4$-NNN'N'-tetrakis(2hydroxylpropyl)ethylenediamine plating liquid will be doubled.

The addition amount of the borofluoride is neither particularly limited nor critical relative to the copper salt.

Borofluoride added in an amount of from 2 to 5 equivalents relative to the copper salt approximately triples the plating deposition speed compared with the case in which no addition is made. $KBF_4$, $RbBF_4$, $CsBF_4$, and the like are difficult to dissolve in water, but $LiBF_4$ and $NaBF_4$ are easily dissolved in water. Therefore, an excessive addition of $LiBF_4$ and $NaBF_4$ is not detrimental. The deposition speed of plating and the properties of a coating are not affected by the addition amount of $NaBF_4$ and the like in the concentration range where an appreciable enhancement of the plating deposition speed, e.g., at least double, is attained. Accordingly, it is not necessary to frequently adjust the bath composition during the plating progress, in which the copper and the like are consumed.

As is shown in FIG. 1, when the addition amount of $NaBF_4$ exceeds a certain concentration, the effect thereof is saturated but not critically reduced.

An appropriate amount of $NaBF_4$ is from 2 to 5 equivalents relative to the Cu concentration.

The operation to be applied to a workpiece when using a chemical copper-plating bath according to the present invention is not particularly different from the conventional operation, and the chemical copper-plating bath of the present invention is applicable to any production method.

The copper coating formed by the chemical plating bath according to the present invention has a deeper luster than that obtained by the conventional low speed or high speed bath. The chemical copper-plating bath according to the present invention is, therefore, also useful for the electroless plating of ornamental parts for which an aesthetic appeal is required. The luster of a plating coating depends mainly upon the particle size of the deposited metal, i.e., the deepest luster is given by the fine particles. In this connection, borofluoride appears to have a function of refining the size of the precipitated metal particles.

The present invention is now described in more detail by way of Examples, which in no way limit the scope of the present invention.

EXAMPLES

Stainless steel sheets were subjected to a catalytic treatment by Pd metal and then to a chemical plating process for 15 minutes, using plating liquids having the compositions given in Table 1. In the plating liquids, the concentration of copper ions [$Cu^{2+}$] was 0.06 mol/l the concentration of the complexing agent was 0.11 mol/l, the concentration of the reducing agent (HCHO) was 0.25 mol/l, and the pH was 12.5 (25° C.). The plating load (area to be plated relative to volume of plating liquid) was 100 $cm^2$/l.

TABLE 1

| | Example Nos. | | | | | | | | | | | | | | | | | | |
|---|---|---|---|---|---|---|---|---|---|---|---|---|---|---|---|---|---|---|---|
| | 1 | 2 | 3 | 4 | 5 | 6 | 7 | 8 | 9 | 10 | 11 | 12* | 13 | 14 | 15 | 16 | 17 | 18 | 19 |
| Copper Salt | | | | | | | | | | | | | | | | | | | |
| $CuCl_2$ | o | o | o | o | o | — | — | — | — | — | — | o | o | o | o | o | o | o | — |
| $CuSO_4$ | — | — | — | — | — | o | o | o | o | o | o | — | — | — | — | — | — | — | o |
| Complexing Agent | | | | | | | | | | | | | | | | | | | |
| NNN'N'—tetrakis(2-hydroxypropyl)-ethylenediamine | o | o | o | o | o | o | o | o | — | — | — | o | o | o | o | — | — | — | o |
| EDTA | — | — | — | — | — | — | — | — | o | o | o | — | — | — | — | o | o | o | — |
| Borofluoride (mol/l) | | | | | | | | | | | | | | | | | | | |
| $LiBF_4$ | 0.2 | — | — | — | — | — | 0.2 | — | 0.2 | — | — | — | 0.1 | — | — | 0.2 | — | — | — |
| $NaBF_4$ | — | 0.2 | — | — | — | 0.2 | — | — | — | 0.2 | — | — | — | 0.1 | 0.2 | — | 0.1 | 0.2 | 0.15 |
| $KBF_4$ | — | — | 0.02 | — | — | — | — | 01. | — | — | 01. | — | — | — | — | — | — | — | — |
| $RbBF_4$ | — | — | — | 0.01 | — | — | — | — | — | — | — | — | — | — | — | — | — | — | — |
| $CsBF_4$ | — | — | — | — | 0.01 | — | — | — | — | — | — | — | — | — | — | — | — | — | — |
| Additive (mg/l) | | | | | | | | | | | | | | | | | | | |
| 2,2'-bipyridyl | — | — | — | — | — | — | — | — | — | — | — | 20 | 20 | 20 | 20 | 20 | 20 | 20 | 10 |
| Potassium ferrocyanide | — | — | — | — | — | — | — | — | — | — | — | 30 | 30 | 30 | 30 | 30 | 30 | 30 | — |
| Thyourea | — | — | — | — | — | — | — | — | — | — | — | — | — | — | — | — | — | — | 1 |
| Bath Temperature (°C.) | 45 | 45 | 45 | 45 | 45 | 45 | 45 | 45 | 45 | 45 | 45 | 50 | 50 | 50 | 50 | 60 | 60 | 60 | 70 |
| Plating Deposition speed [μm/hr] | 29 | 30 | 25 | 22 | 15 | 30 | 32 | 20 | 18 | 15 | 12 | 0.3 | 4.5 | 3.0 | 4.0 | 2.8 | 2.4 | 3.4 | 18 |

Remarks: Example 12* is a comparative example with an additive.

As is apparent from the results shown in Table 1, borofluoride effectively accelerates the plating deposition speed irrespective of the kind of copper salt and complexing agent included in the composition. This effect is also apparent in the baths with known additives. In Comparative Example 12, two kinds of additives, i.e., 2-2'-bipyridyl and potassium ferrocyanide, were used, and the deposition speed was 0.3 μm/hr, and therefore extremely slow. In the Inventive Examples 13–18, borofluoride was added in an amount of from 0.1 to 0.2 mol/l and the deposition speed was 3~4 μm/hr. However, when a stabilizing agent was used, the bath stability was enhanced and thus the bath temperature would be enhanced. Therefore, as shown in Example 18, a high speed chemical plating of copper was easily realized.

Note, $KBF_4$, $RbBF_4$, and $CsBF_4$, are not easily dissolved in water, and were not dissolved in water at the concentrations given in the Examples. However, if any particular difficulty arose due to this insolubility, the experiments were continued in the nondissolved state of $KBF_4$, and the like.

We claim:

1. A chemical copper-plating bath, including a copper salt, a complexing agent, a reducing agent, a pH-adjusting agent, and an additive of borofluoride for accelerating the plating deposition speed.

2. A chemical copper-plating bath according to claim 1, wherein the borofluoride contains $BF_4$.

3. A chemical copper-plating bath according to claim 2, wherein the borofluoride is at least one selected from the group consisting of $NaBF_4$, $KBF_4$, $LiBF_4$, $RbBF_4$, and $CsBF_4$.

4. A chemical copper-plating bath according to claim 3, wherein said borofluoride is contained in an amount whereby a plating deposition speed is at least doubled compared with a plating deposition speed without said additive.

5. A chemical copper-plating bath according to claim 1, wherein said borofluoride is contained in an amount of from 2 to 5 equivalents relative to the copper salt.

6. A chemical copper-plating bath according to claim 1, wherein the complexing agent is at least one selected from the group consisting of NNN'N'-tetrakis(2hydroxypropyl)ethylenediamine and EDTA.

7. A chemical copper-plating bath according to claim 1, wherein the reducing agent is at least one selected from the group consisting of formalin, sodium hypophosphate, and hydrazine.

8. A chemical copper-plating bath according to claim 1, wherein the pH-adjusting agent is at least one selected from the group consisting of sodium hydroxide, potassium hydroxide, and ammonium.

9. A chemical copper-plating bath according to claim 8, wherein the pH is 11.5 or more (at 25° C.).

10. A chemical copper-plating bath according to claim 5, wherein the plating deposition speed is approximately 10 μm/hour or more at 45° C.

11. A chemical copper-plating bath according to claim 10, wherein the plating deposition speed is approximately 30 μm/hour or more at 45° C.

12. A chemical copper-plating bath according to claim 3, 6, or, 9, wherein said copper salt is copper sulfate.

13. A chemical copper-plating bath according to claim 3, 6, or, 9, wherein said copper salt is copper chloride.

14. A chemical copper-plating bath according to claim 3, wherein said borofluoride is selected from the group consisting of $KBF_4$, $RbBF_4$, and $CsBF_4$, and is not completely dissolved therein.

15. A chemical copper-plating bath according to claim 3, 6, or 9, further comprising a stabilizing agent.

16. A chemical copper-plating bath according to claim 15, wherein said borofluoride is contained in an amount whereby the plating deposition speed is at least doubled compared with a plating deposition speed without said additive.

17. A chemical copper-plating bath according to claim 16, wherein the plating deposition speed is approximately 2 μm/hour or more at 45° C.

* * * * *